United States Patent [19]

Davies et al.

[11] Patent Number: 4,530,774

[45] Date of Patent: Jul. 23, 1985

[54] FABRIC WASHING PROCESS AND DETERGENT COMPOSITION FOR USE THEREIN

[75] Inventors: James F. Davies, Merseyside; Andrew T. Hight, Cheshire; Robert S. Lee, Merseyside, all of England

[73] Assignee: Lever Brothers Company, New York, N.Y.

[21] Appl. No.: 556,659

[22] Filed: Nov. 30, 1983

[30] Foreign Application Priority Data

Dec. 17, 1982 [GB] United Kingdom ..... 8236004

[51] Int. Cl.[3] ..... C11D 17/06

[52] U.S. Cl. ..... 252/108; 252/132; 252/133; 252/160; 252/174

[58] Field of Search ..... 252/91, 92, 96, 108, 252/132, 133, 156, 174, 174.13, 174.14

[56] References Cited

U.S. PATENT DOCUMENTS

| | | | |
|---|---|---|---|
| 4,144,226 | 3/1979 | Crutchfield et al. | 525/401 |
| 4,146,495 | 3/1979 | Crutchfield et al. | 252/174.21 |
| 4,196,095 | 4/1980 | Cala . | |
| 4,210,550 | 7/1980 | Cornelissens | 252/90 |
| 4,273,835 | 6/1981 | Higuchi . | |
| 4,305,836 | 12/1981 | Noguchi et al. . | |
| 4,407,722 | 10/1983 | Davies et al. | 252/91 |

FOREIGN PATENT DOCUMENTS

| | | |
|---|---|---|
| 68721 | 1/1983 | European Pat. Off. . |
| 3004140 | 8/1980 | Fed. Rep. of Germany . |
| 379760 | 9/1932 | United Kingdom . |
| 808945 | 2/1959 | United Kingdom . |
| 1424406 | 2/1976 | United Kingdom . |
| 1425177 | 2/1976 | United Kingdom . |
| 1473201 | 5/1977 | United Kingdom . |
| 1473202 | 5/1977 | United Kingdom . |
| 1507312 | 4/1978 | United Kingdom . |
| 1509797 | 5/1978 | United Kingdom . |
| 1557568 | 12/1979 | United Kingdom . |
| 2047264 | 11/1980 | United Kingdom . |

*Primary Examiner*—Paul Lieberman
*Assistant Examiner*—Hoa Van Le
*Attorney, Agent, or Firm*—Milton L. Honig; James J. Farrell

[57] ABSTRACT

Particulate detergent compositions, especially for use in cold water, contain a detergent active material, an alkaline material and builder particles comprising a carrier material and a saturated fatty acid having at least 16 carbon atoms. The carrier material is water-soluble or water-dispersible to release the fatty acid when the composition is added to a wash liquor. The builder particles have a size of 50 to 5000 microns. Suitable carrier materials include starch, clay, silica and inorganic salts. The fatty acid may be in solid solution with a dispersant such as a nonionic surfactant. When the alkaline material is carbonate, the addition of the builder particles to the wash liquor may be delayed until after a critical state is reached.

8 Claims, No Drawings

FABRIC WASHING PROCESS AND DETERGENT COMPOSITION FOR USE THEREIN

TECHNICAL FIELD

This invention relates to a method of washing fabrics and to a composition useful in carrying out such a process.

BACKGROUND ART

Detergent manufacturers have long recognised the need to control water hardness to ensure adequate cleaning by detergents. The detergency builders used in the past have been of three main types, namely water-soluble sequestering builders, water-insoluble ion exchange builders and water-soluble precipitating builders. A typical precipitating builder is an alkali metal carbonate, especially sodium carbonate. Other water-soluble precipitating builders include sodium silicate (particularly effective against magnesium hardness), sodium orthophosphate and water-soluble alkali metal soaps. While from a cost point of view sodium carbonate is an attractive builder, it has at least two significant disadvantages. Firstly, sodium carbonate alone is not usually capable of reducing the calcium ion concentration in calcium hard water to sufficiently low levels to achieve good detergency under practical washing conditions. This is because crystal growth is inhibited by materials, in particular condensed phosphates, which can arise from the soiled load, or be present as contamination in the detergent composition. Secondly, the use of carbonate ions to precipitate the calcium hardness from the water can result in the deposition of calcium carbonate on the washed fabrics. It is known that the calcium carbonate precipitate is produced in such a crystal type and such a particle size that deposition on the fabrics is favoured. The presence of certain crystal growth poisons in the wash liquor can encourage this deposition. Typical such poisons are inorganic phosphates carried into the wash liquor from the soiled fabrics in cases where the fabrics have previously been washed in a composition containing tripolyphosphate.

The calcium ion concentration in a wash liquor can be reduced to sufficiently low levels by the use of, for example, a sequestering builder material such as sodium tripolyphosphate, and considerable commercial success has been achieved with phosphate-built formulations. However it has now become apparent that, under some conditions, the discharge of significant quantities of phosphates into waste waters may produce environmental problems. There is therefore an increasing desire in some countries to reduce the level of phosphorus in detergent compositions.

It has previously been thought that it was essential for precipitating builders to be substantially soluble at the temperature of use to achieve efficient water softening. With the present trend towards washing fabrics at lower temperatures with a view to saving energy costs, it has not previously been thought possible to use, as a precipitating builder material, materials which themselves are not substantially soluble in water at low temperatures. Thus, the fatty acids, which are not substantially soluble in water at room temperature, have not previously been proposed as precipitating builder materials.

We have now surprisingly found that particular fatty acids can be incorporated together with a carrier material into a builder particle and by including these particles in detergent compositions which contain an alkaline material, efficient building of calcium-hard water can be achieved, even at low temperatures.

Thus, according to a first aspect of the invention, there is provided a particulate solid detergent composition comprising:

(i) a non-soap detergent active material;

(ii) an alkaline material capable of providing the composition with a pH of more than 8.0, when added to water of 12° French hardness (Ca) at 25° C. and at a concentration of 1.0 g/l; and (iii) at least 10% by weight of a builder material, characterised in that said builder material is a saturated fatty acid, of which contains at least 16 carbon atoms and said fatty acid is in the form of particles having a particle size of between 50 microns and 5000 microns and comprising said fatty acid in a heterogenous mixture with a water-soluble or water-dispersible carrier material.

DISCLOSURE OF THE INVENTION

An essential feature of the compositions of the present invention is the presence of an alkaline material.

The compositions of the invention are required to be alkaline, but not too strongly alkaline as this could result in fabric damage and also be hazardous for domestic usage. In practice the compositions should give a pH of more than 8.0, preferably from 9.5 to 11 in use in aqueous wash solution. The pH is measured at the lowest normal usage concentration of 0.1% w/v of the product in water of 12° (Ca) (French permanent hardness, calcium only) at 25° C. so that a satisfactory degree of alkalinity can be assured in use at all normal product concentrations.

The alkaline material may be selected from alkali metal and ammonium salts of weak acids such as alkali metal and ammonium carbonates including sodium carbonate and sodium sesquicarbonate, alkali metal and ammonium silicates including sodium alkaline silicate, alkali metal and ammonium phosphates including sodium orthophosphate, alkali metal hydroxides including sodium hydroxides, alkali metal borates and the alkali metal and ammonium water-soluble salts of weak organic acids including sodium citrate, sodium acetate, and the cold water soluble soaps such as sodium oleate, and mixtures of such materials.

In some cases the alkaline material will itself also act as a builder. Thus, for example, sodium carbonate will contribute to building by precipitation of calcium carbonate while sodium citrate will contribute to building by sequestering calcium ions. In this case it may be beneficial to further include, as an alkaline material, a material which is relatively calcium insensitive, such as sodium silicate, so as to maintain a high pH throughout the wash. The other ingredients in the alkaline detergent compositions of the invention should of course be chosen for alkaline stability, especially the pH sensitive materials such as enzymes.

The builder particles essentially consist of a carrier material and a fatty acid. The fatty acid is essentially insoluble in the carrier material to effectively increase and maintain the surface area of the fatty acid in the composition. It is essential for the carrier material to be soluble or dispersible in water, thereby to release the fatty acid into the wash liquor.

Examples of carrier materials which may be used to form builder particles include: inorganic water-soluble salts such as sodium perborate (monohydrate, correctly designated anhydrate and tetrahydrate, correctly designated hexahydrate), mono-, di- and trivalent metal sulphates, especially alkali metal sulphates and more especially sodium sulphate, alkali metal double sulphates, especially the alums, alkali metal phosphates, especially sodium tripolyphosphate pyrophosphate and orthophosphate, alkali metal carbonates, especially sodium carbonate, sodium hydrogen carbonate and sodium sesquicarbonate, and their mixed carbonates, and also mixtures of any of these inorganic water-soluble salts; inorganic water-insoluble materials such as naturally occurring silicas, precipitated silicas and silica gels, alumina and alumino-silicate materials including zeolites and clays; water-soluble organic materials such as carbohydrates, especially crystalline sugars such as sucrose, solid, preferably crystalline, polyhydric alcohols, such as pentaerythritol, sorbitol and mannitol; water-soluble film forming materials such as polysaccharides, especially derivatives of starch and cellulose; synthetic polymers such as polyacrylates; and proteins such as gelatin.

The effectiveness of the fatty acid is further enhanced by mixing the fatty acid with a material with which it is miscible in the solid state, i.e. with which it is capable of forming a solid solution. Such material is referred to herein as a dispersant for the fatty acid. Examples of such dispersants include long chain ($>C_4$) compounds with a straight or branched chain, an optional aromatic ring or cycloaliphatic group and one or more hydrophilic groups, e.g. hydroxyl, amino, amine oxide, carboxy or sulphobetaine groups. These compounds may be used separately or in admixture and are able to form a solid solution with $C_{16}$–$C_{18}$ saturated fatty acids. These compounds may be soluble or insoluble in water.

Examples of such compounds are surfactants (nonionic, amine oxide, carboxy or sulphobetaine, alkanols, alkanediols, alkanedioic acids, alkanoic acid mono- or diethanolamides, and alkyl amines.

The preferred level of fatty acid in the builder particles depends inter alia on the nature of the carrier material and on whether the composition contains further builder materials. Thus, where the carrier material serves little or no purpose in the composition other than to carry the fatty acid, it is clearly desirable that the level of carrier material should be as low as possible. In this case up to 95% of the builder particles may be constituted by the fatty acid. However, where the carrier material serves some other useful purpose in the composition, the level of fatty acid in the builder particles can be less, say up to 80%. A further consideration is that the efficiency of building, all other factors remaining the same, depends on size of fatty acid particles which are released into the wash liquor, smaller sizes resulting in faster building. Thus, for example when the builder particles are heterogeneous, a lower level of fatty acid in the builder particles may lead to smaller particles of fatty acid being released into the wash liquor, which in turn leads to more efficient building.

In practice however, it is preferred for the level of fatty acid in the builder particles to be between 20% and 95%.

The builder particles may be made by a variety of techniques. Where the carrier material is soluble at least in hot water (such as starch) an aqueous emulsion may be formed of the molten fatty acid in the hot starch solution, and the emulsion then transformed in builder particles by spray drying or by fluid-bed agglomeration.

Alternatively, the fatty acid can be melted and sprayed as fine droplets by means of suitable atomising equipment onto a moving bed of carrier material, or mixture of carrier materials, by any convenient granulation technique, e.g. rotating drum, inclined pan granulator, fluidised bed and solid mixer. An even distribution of solidified fatty acid through the carrier material can thus be obtained. The carrier material can be milled to smaller particle sizes (e.g. using a swing-hammer mill) before the fatty acid is applied so as to increase the weight of fatty acid that can be carried by a given weight of said carrier material.

The particle size of the builder particles, as measured by sieve analysis, should be such that the majority of the particles have a size between 50 microns and 5000 microns, preferably between 100 microns and 1500 microns.

The fatty acid which can be used in the present invention should contain saturated alkyl groups and shall contain at least 16 carbon atoms, preferably not more than 18 carbon atoms. Fatty acids containing less than 16 carbon atoms are unsuitable for the present purposes, their corresponding calcium salts having a solubility product which is not sufficiently low for acceptable building to be possible. Fatty acids derived from natural sources will normally contain a mixture of alkyl chain lengths, and may often contain unsaturated and/or hydroxy-substituted alkyl chains. In such circumstances it is essential that at least 30%, preferably at least 40% of the fatty acid consists of acids in which the alkyl chain is saturated and the fatty acids contain at least 16 carbon atoms, preferably from 16 to 18 carbon atoms. Suitable fatty acids for use in the present invention include palmitic acid, stearic acid and fatty acid derived from tallow fat or palm oil.

Mixtures of fatty acids may also be used.

The level of builder particles in the detergent composition should be such that the composition contains the equivelent of more than 10% fatty acid. Adequate building of water containing calcium hardness at a typical level can not be achieved at conventional dosage levels with less than 10% fatty acid. The compositions will not normally contain more than 70% fatty acid to allow room for other components in the composition. Preferably the compositions will contain no more than 50%, preferably no more than 40% fatty acid. When a further builder material is present, the compositions may contain 15% or less fatty acid.

The detergent compositions are particularly suitable for washing fabrics at low temperatures i.e. below 50° C., even below 35° C. Successful results can also be achieved at temperatures above 50° C.

The wash liquor according to the invention necessarily includes a synthetic detergent active material otherwise referred to herein simply as a detergent compound. The detergent compounds may be selected from anionic, nonionic, zwitterionic and amphoteric synthetic detergent active materials. Many suitable detergent compounds are commercially available and are fully described in the literature, for example in "Surface Active Agents and Detergents" volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from 8 to 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$)alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, i.e. 5 to 25 units of ethylene oxide per molecule, the condensation products of aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relative high cost. If any amphoteric or zwitterionic detergent compounds are used it is generally in small amounts in compositions based on the much more commonly used synthetic anionic and/or nonionic detergent compounds.

For example, mixtures of amine oxides and ethoxylated nonionic detergent compounds can be used.

Cold water-soluble soaps may also be present in the detergent compositions of the invention. The soaps are particularly useful at low levels in binary and ternary mixtures, together with nonionic or mixed synthetic anionic and nonionic detergent compounds, which have low sudsing properties. The soaps which are used are the water-soluble salts of unsaturated fatty acids in particular with inorganic cations such as sodium and potassium. The amount of such soaps can be between 2% and 20%, especially between 5% and 15%, can advantageously be used to give a beneficial effect on detergency.

The compositions of the invention may contain a further builder material other than the fatty acid.

Where the further builder material is other than sodium or potassium carbonate this may be present at levels less than the level of the fatty acid. Where the composition contains sodium or potassium carbonate as the alkaline material and as a further builder, this may be present at a level more than the level of the fatty acid.

Any such further builder material may be selected from other precipitating builder materials optionally together with a precipitation seed material, or from sequestering builder materials and ion-exchange builder materials and materials capable of forming such builder materials in situ.

Where the further builder material is a water-soluble precipitating material, it may be selected from soaps, alkyl malonates, alkenyl or alkyl succinates, sodium fatty acid sulphonates, orthophosphates of sodium, potassium and ammonium, or in their water-soluble partially or fully acidified forms. Particularly where the hard water contains magnesium ions, the silicates of sodium and potassium may be included in the compositions.

The further builder may also be constituted by a sequestering builder material, particularly those selected from water-soluble pyro-phosphates, poly-phosphates, phosphonates, polyhydroxy-sulfonates, polyacetates, carboxylates, polycarboxylates, and succinates.

Specified examples of inorganic phosphate builders include sodium and potassium tripolyphosphates, pyrophosphates, and polymerphosphates such as hexametaphosphate or glassy phosphates. The polyphosphonates specifically include, for example, the sodium and potassium salts of ethane 1-hydroxy-1,1-di-phosphonic acid and the sodium and potassium salts of ethane-1,1,2-triphosphonic acid.

In some embodiments of this invention, the compositions will not contain more than about 5% by weight phosphate builder materials or phosphorus containing materials of any kind.

Water-soluble, organic sequestering builders are also useful herein as further builder materials. For example, the alkai metal, ammonium and substituted ammonium polyacetates, carboxylates, polycarboxylates, polyacetylcarboxylates and polyhydroxysulfonates are useful sequestering builders in the present compositions. Specific examples of the polyacetate and polycarboxylate builder salts include sodium, potassium, ammonium and substituted ammonium salts of ethylene diamine tetraacetic acid, nitriloacetic acid, dipicolinic acid, oxydisuccinic acid, benzene polycarboxylic acids e.g. mellitic acid, citric acid and the polyacetalcarboxylates disclosed in U.S. Pat. Nos. 4,144,226 and 4,146,495. The acid forms of these materials may also be used.

Highly preferred organic sequestering builder materials herein include sodium citrate, sodium oxydisuccinate, sodium mellitate, sodium nitrilotriacetates, and sodium ethylene diamine tetraacetate and mixtures thereof.

Other highly preferred sequestering builders are the polycarboxylate builders. Examples of such materials include the water-soluble salts of the homo- and copolymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid, and ketomalonic acid.

Additional preferred sequestering builders herein include the water-soluble salts, especially the sodium and potassium salts of carboxy methyloxymalonate, carboxy methyloxysuccinate, cis-cyclohexanehexacarboxylate, cis-cyclopentanetetracarboxylate, and phloroglucinol trisulfonate.

The further builder material may also be constituted by an ion-exchange material. Suitable ion-exchange materials include the amorphous or crystalline aluminosilicates such as disclosed in GB No. 1 473 201/2 (HENKEL).

When the further fuilder material is an ion-exchange material, it may be present at a level which is more than the level of the fatty acid.

In a wash liquor containing sodium carbonate as an alkaline material, the precipitation of calcium carbonate by reaction between the calcium hardness and the sodium carbonate takes place via a series of steps which are transient in the absence of crystal growth poisons, but can be isolated in their presence. If the builder particles are added after the system has reached a particular state referred to herein as the "critical state", the free calcium ion concentration in the wash liquor is reduced to about $10^{-5}$ molar or lower. If, on the other hand, the builder particles are added prior to the system reaching the critical state, this reduction in free calcium ion concentration may not be achieved at all or not within a reasonable time.

The time period required for a system to reach the critical state after the addition of sodium carbonate to the hard water is thought to depend on a number of factors among which are the initial water hardness, the quantity of sodium carbonate added, the quantity of crystal growth poisons present either from the wash load, from the added composition or in the liquor itself, the pH of the liquor, the temperature or temperature profile of the liquor and the nature of other materials which may be present.

According to a preferred feature of the invention there is provided a method of washing fabrics in water containing calcium hardness, comprising contacting the fabrics with a wash liquor to which has been added at least a synthetic detergent active material and an alkali metal carbonate and bringing into effective contact with the wash liquor the fatty acid builder particles, the latter being brought into effective contact with the wash liquor at or after the wash liquor has reached the critical state as hereinbefore defined, and being added in such an amount as to reduce the free calcium ion concentration in the wash liquor to $10^{-5}$ or less within at most 60 minutes preferably within 30 minutes from the addition of the alkali metal carbonate to the hard water.

The term "effective contact" between builder particles and the wash liquor as used herein is intended to mean the reaction between the fatty acid salt and the calcium hardness of the water.

The time at which the critical state is reached for a given composition and wash condition may be determined by a series of experiments as follows. A substantially similar load of fabrics is washed in an identical wash liquor under idenical conditions and the builder particles are added at various times between 1 minute and 30 minutes from the addition of the alkali metal carbonate to the liquor. After 60 minutes the free calcium ion concentration is measured. The critical state has been achieved when this final free calcium ion concentration is not more than $10^{-5}$ molar. Alternatively, or where a similar load of soiled fabrics is not available, this series of experiments may be carried out with a clean load of similar fabrics while an appropriate level of crystal growth poison is included in the hard water.

It is also impossible to determine whether the system has reached the critical state by determining one or more of a number of alternative or additional criteria. Thus, when the system has reached its critical state the form of the calcium carbonate precipitate changes from an X-ray amorphous form to an X-ray crystalline form. Still further, the calcium carbonate precipitate is colloidally suspended. When the critical state is reached the precipitate settles rapidly.

When the builder particles are added, some of the already precipitated calcium carbonate may pass back into the solution, for the calcium ions to be precipitated as calcium soap. It is found that, after the system has reached the critical state, at least about 40% of the initial calcium hardness remains as the solid calcium carbonate form when the builder particles are added.

When the conditions are such that the precipitation of calcium carbonate occurs in such a manner that calcium carbonate hexahydrate is formed, it is found that this form of calcium carbonate has disappeared when the system reaches its critical state. The transient formation of the hexahydrate may occur in conditions of high water hardness, high poison levels, low temperatures and in the absence of seed crystals.

One may take steps to promote occurrence of the critical state. Such promotion may be achieved for example by (a) adding to the wash liquor up to 1.5 g/l, preferably up to 1.0 g/l of a seed crystal such as fine particulate calcium carbonate (e.g. calcite, vaterite and aragonite);
(b) increasing the initial hardness of the water by adding to the wash liquor a source of calcium ions such as calcium chloride; or
(c) adding to the wash liquor a calcium carbonate growth poison suppressing agent such as a source of aluminium ions (e.g. aluminium sulphate).

Alternative calcium carbonate growth poison suppressing agents include the soluble salts of lanthanum, iron, cobalt, manganese and copper.

Where the promotion of the critical state is achieved by the addition of a seed crystal, this material is preferably calcite having a surface area of from 2 to 80 $m^2/g$. Suitable materials are Calofort U, available from Sturge Chemicals having a surface area of about 16 $m^2/g$ and calcite having a larger surface area (such as for example 80 $m^2/g$) as available from Solvay. In the latter case less of the material would be necessary. A level of up to 15% by weight of calcite in the composition is suitable.

Particularly where the composition contains a material to promote the critical state, the builder particles are added to the wash liquor or the fatty acid content thereof is released into the wash liquor between about one and about ten minutes after the addition of the sodium carbonate.

A composition according to this embodiment of the present invention may comprise at least (i) from 2.0% to 30% of at least one non-soap detergent active material;
(ii) at least 10% of an alkali metal carbonate as an alkaline material; and
(iii) the builder particles in such an amount as to be equivalent to at least 10% fatty acid, the builder particles being adapted to delay the reaction between the fatty acid and the calcium hardness of the water until the critical state is reached. Such delay may be achieved by suitable choice of the the carrier material and the level of fatty acid therein, or by coating or encapsulating the builder particles with a water-soluble or water-dispersible material in any convenient apparatus suitable for coating or encapsulating powders, e.g. an inclined pan granulator, fluidised bed, solid mixer, extruder, rotating drum. Examples of such coating materials include sodium silicate, polyethyleneglycol, polyvinylalcohol, fatty acids $C_{12}$–$C_{22}$, long chain aliphatic alcohols, paraffin waxes, nonionic surface active agents, starch and cellulose derivatives, gelatin and sugars.

Particularly preferred compositions according to the invention contain, based on the weight of the total composition:

from 5% to 30%, such as between 8% and 25% of at least one non-soap detergent active material;
from 10% to 80%, preferably from 15%, more preferably from 20% to 40% of an alkali metal carbonate;
up to 15%, preferably from 6% to 12% calcite; and
up to 20%, preferably up to 15% of fatty acid in the form of builder particles.

The balance of the composition, if any, will be water and other conventional additives as referred to below.

As an alternative to the above described method of washing fabrics in which the fabric washing composition contains sodium carbonate as a further builder material and in which effective contact between the wash liquor and the fatty acid is delayed until the system reaches the critical state, it may also be beneficial to arrange that the fatty acid comes into effective contact with the wash liquor relatively rapidly, and the reaction between the sodium carbonate and the free calcium ions in the wash liquor is retarded by including in the composition a calcium-carbonate crystal growth inhibitor, such as a phosphate material.

Apart from the essential detergent active compounds and detergency builders, the detergent compositions used in the process of the invention can contain any of the conventional additives in the amounts in which such materials are normally employed in fabric washing detergent compositions. Examples of these additives include lather boosters such as alkanolamines, particularly the mono-ethanolamides derived from palm kernel fatty acids and coconut fatty acids, lather depressants such as alkyl phosphate, long-chain fatty acids or soaps thereof, waxes and silicones, antiredeposition agents such as sodium carboxymethylcellulose and cellulose ethers, oxygen-releasing bleaching agents such as sodium perborate and sodium percarbonate, per-acid bleach precursors, chlorine-releasing bleaching agents such as trichloroisocyanuric acid, fabric softening agents, inorganic salts, such as sodium sulphate, and magnesium silicate, and usually present in very minor amounts, fluorescent agents, perfumes, enzymes such as proteases and amylases, germicides and colourants.

It is particularly beneficial to include in the detergent compositions an amount of sodium perborate or percarbonate, preferably between 10% and 40%, for example 15% to 30% by weight.

It is desirable to include one or more antideposition agents in the detergent compositions of the invention, to further decrease the tendency to form inorganic deposits on washed fabrics. The most effective antideposition agents are anionic poly electrolytes, especially polymeric aliphatic carboxylates. The amount of any such antideposition agent can be from 0.01% to 5% by weight, preferably from 0.2% to 2% by weight of the compositions.

Specific preferred antideposition agents are the alkali metal or ammonium, preferably the sodium, salts or homo- and co-polymers of acrylic acid or substituted acrylic acids, such as sodium polyacrylate, the sodium salt of copolymethacrylamide/acrylic acid and sodium poly-alphahydroxyacrylate, salts of copolymers of maleic anhydride with ethylene, acrylic acids, vinylmethylether allyl acetate or styrene, especially 1:1 copolymers, and optionally with partial esterification of the carboxyl groups. Such copolymers preferably have relatively low molecular weights, e.g. in the range of 1,000 to 50,000. Other antideposition agents include the sodium salts of polyitaconic acid and polyaspartic acid, phosphate esters of ethoxylated aliphatic alcohols, polyethylene glycol phosphate esters, and certain phosphonates such as sodium ethane-1-hydroxy-1,1-diphosphonate, sodium ethylenediamine tetramethylene phosphonate, and sodium 2-phosphonobutane tricarboxylate. Mixtures of organic phosphonic acids or substituted acids or their salts with protective colloids such as gelatin may also be used. The most preferred antideposition agent is sodium polyacrylate having a MW of 10,000 to 50,000, for example 20,000 to 30,000. Where the antideposition agent is itself a calcium carbonate crystal growth poison, or in any case, and the composition contains sodium carbonate as a further builder material, it may be desirable to delay contact between this agent and the wash liquor until after the critical state is reached.

Even if the alkaline material other than an alkali metal silicate is included in the composition, it is generally also desirable to include an amount of an alkali metal silicate, to decrease the corrosion of metal parts in washing machines and provide processing benefits and generally improved powder properties. The presence of such alkali metal silicates, particularly sodium ortho-, meta- or preferably neutral or alkaline silicate, at levels of at least 1%, and preferably from about 5% to 15%, by weight of the composition, is advantageous. The more highly alkaline ortho- and meta- silicates would normally only be used at lower amounts within this range, in admixture with the neutral or alkaline silicates.

The washing process of the invention can be accomplished manually, if desired, but is normally accomplished in a domestic or commercial laundry washing machine. The latter permits the use of higher alkalinity, and more effective agitation, all of which contribute generally to better detergency. The type of washing machine used, if any, is not significant.

The detergent compositions of the invention should be solid particulate compositions, prepared in such a manner as to minimise substantial reaction between the alkaline material and the fatty acid. Dry-mixing and granulation of all components may be used or alternatively the fatty acid containing particles may be post-dosed to a spray-dried base powder.

The invention will now be further illustrated with reference to the following Examples.

EXAMPLE 1

Builder particles containing a fatty acid and a carrier material were prepared as follows. The carrier material was dissolved in water and heated to a temperature above the melting point of the fatty acid used. The fatty acid was then added and homogenised to form an emulsion. The emulsion was converted into builder particles by one of two possible techniques, namely spray-drying or fluid-bed agglomeration.

For Example 1A the fatty acid was Pristerene 4934, available from Unichema Chemicals Limited, a partially hardened tallow fatty acid containing about 86% saturated fatty acids having between 16 and 18 carbon atoms, and about 11% $C_{18}$ unsaturated fatty acid, the balance being primarily saturated fatty acids with less than 16 carbon atoms. The carrier material was an acid thinned chemically modified starch. The particles contained 87.5% fatty acid and were prepared by spray-drying. The size of the particles used for the tests detailed below was 180–250 microns.

For Example 1B the same fatty acid was used. The carrier material was a commercially available material which is an acid-thinned dextrinised starch. The particles contained 60% fatty acid and were prepared by fluid-bed agglomeration. The particle size range used in the tests detailed below was 710–1000 microns.

The particles were tested as follows. The following were added at 25° C. to water having a hardness of 24° FH (22.4 Ca/1.6 Mg) and containing about 10 ppm sodium tripolyphosphate to represent a calcium carbonate crystallisation inhibitor, namely 1.5 g/l sodium carbonate, 0.5 g/l calcite (CALOFORT "U"), and 0.5 g/l Synperonic 13/15 7EO and sufficient builder particles to be equivalent to 0.75 g/l fatty acid.

By the use of a calcium sensitive electrode, the concentration of free calcium ions after five minutes was measured. In the case of particles of Example 1A the free calcium ion concentration was about 0.09° FH. In the case of particles of Example 1B the free calcium ion concentration was about 0.1° FH. In the absence of builder particles, the free calcium concentration was about 1° FH after five minutes.

The Example demonstrates that the water is softened by the combination of the sodium carbonate and these fatty acid builder particles.

EXAMPLE 2

Example 1A was repeated except that the builder particles were added one minute after the other ingredients. After a further four minutes the free calcium ion concentration was 0.02° FH.

This Example demonstrates the further benefit of delaying the addition of the builder particles to the hard water.

EXAMPLE 3

The following were added at 25° C. to hard water, having a hardness of 24° FH (22.4 Ca, 1.6 Mg): 0.75 g/l alkali (sodium carbonate measured as anhydrous or sodium silicate $SiO_2/Na_2O=1.6$, as indicated below), 0.5 g/l Synperonic 13/15 7EO (nonionic detergent active), 2.0 g/l of fatty acid particles containing 3 parts by weight Prifac 7920 fatty acid and 1 part by weight starch as used in Example 1 and 10 ppm sodium tripolyphosphate as a crystal growth inhibitor.

After five minutes the free calcium ion concentration was 5.7° FH in the case of the sodium carbonate and 2.5° FH in the case of the sodium silicate, demonstrating the benefit of using sodium silicate as the alkaline material under these conditions.

Prifac 7920, available from Unichema Chemicals Ltd., is a commercial fatty acid containing about 44% by weight saturated $C_{16}$ and higher fatty acids, the balance being predominantly unsaturated $C_{18}$ fatty acid.

EXAMPLE 4

Builder particles were prepared by spraying molten fatty acid onto particulate carrier material in a fluidised bed. The fatty acid was Pristerene 4934 as used in Example 1. The carrier materials, fatty acid/carrier ratios and particle sizes were as set out below.

The builder particles were added to water having a hardness of 24° FH at a level equivalent to 0.75 $g/l^{-1}$ fatty acid, together with 1.5 $g/l^{-1}$ sodium carbonate, 0.5 $g/l^{-1}$ calcite (CALOFORT "U"), 0.5 $g/l^{-1}$ Synperonic 13/15 7EO and 10 ppm sodium tripolyphosphate. After 15 minutes at 25° C. the calcium ion concentration was measured.

The results are given in the following Table.

| Carrier material | Fatty acid/ carrier ratio | Builder particle size (microns) | °FH after 15 minutes |
|---|---|---|---|
| Sodium perborate tetrahydrate | 0.6:1 | 200–1000 | 0.03 |
| Sodium perborate monohydrate | 2:1 | about 550 average | 0.02 |
| Precipitated silica | 4:1 | about 150 average | 0.02 |
| Bentonite (ex BDH) | 2:1 | 100–550 | <0.01 |

In the absence of builder particles, the free calcium ion concentration was >0.5° FH after fifteen minutes.

EXAMPLE 5

Example 4 was repeated using the following builder particles, which contained, in addition to the fatty acid and the carrier material, a nonionic detergent active material as a dispersant. The nonionic was added to the molten fatty acid and the reaulting mixture was sprayed onto the carrier particles. The builder particles were tested as described in Example 4, and the results, together with the composition of the particles, are given in the following Table. All particles were in the size range of 100 microns to 550 microns.

| | EXAMPLE NO: | | |
|---|---|---|---|
| INGREDIENTS (%) | 5A | 5B | 5C |
| Pristerene 4934 | 51 | 66.7 | 52.5 |
| Synperonic 7EO | 8.5 | 11.1 | 17.5 |
| Bentonite (ex BDH) | 40.5 | — | — |
| Precipitated silica | — | 22.2 | — |
| Starch (as in Example 1) | — | — | 30.0 |
| °FH after 15 minutes | <0.01 | 0.02 | 0.04 |

We claim:

1. A particulate solid detergent composition comprising:

(i) a non-soap detergent active material;

(ii) an alkaline material capable of providing the composition with a pH of more than 8.0, when added to water of 12° French hardness (Ca) at 25° C. and at a concentration of 1.0 g/l; and (iii) at least 10% by weight of a builder material, said builder material consisting essentially of a saturated fatty acid which contains at least 16 carbon atoms and said fatty acid is in the form of discrete particles having a particle size of between 50 microns and 5000 microns and comprising said fatty acid in a heterogenous mixture with a water-soluble or water-dispersible carrier material; said carrier material is selected from the group consisting of inorganic water-soluble salts, inorganic water-insoluble materials, water-soluble film forming materials, synthetic polymers, proteins and water-soluble organic materials selected from carbohydrates and polyhydric alcohols.

2. A composition according to claim 1, characterised in that the alkaline material is selected from alkali metal carbonates, alkali metal silicates and mixtures thereof.

3. A composition according to claim 1, characterised in that the builder particles further contain a dispersant in solid solution with said fatty acid.

4. A composition according to claim 3, characterised in that the dispersant is selected from surfactants, alkanols, alkanediols, alkanedioic acids, alkanoic acid mono- or diethanolamides, alkylamides and mixtures thereof.

5. A composition according to claim 1, characterised by further comprising a further builder material at a level less than the level of said fatty acid.

6. A composition according to claim 1, characterised in that the builder material is selected from palmitic acid, stearic acid and fatty acids derived from tallow fat and palm oil.

7. A composition according to claim 1, characterised in that it comprises (i) from 5% to 30% of a detergent active material selected from synthetic anionic detergent active materials, nonionic detergent active materials and mixtures thereof;

( ii) from 10% to 80% of sodium carbonate;

(iii) up to 15% calcite; and (iv) from 10% to 20% of fatty acid in the form of builder particles comprising, based on the weight of the particles, from 5% to 80% of said carrier material and from 20% to 95% of said fatty acid.

8. A method of washing fabrics in water containing calcium hardness ions, comprising contacting the fabrics at a temperature below 50° C. with a wash liquor obtained by adding to water a particulate solid detergent composition, characterised by said particulate solid detergent composition being according to claim 1.

* * * * *